United States Patent [19]

Shida

[11] Patent Number: 4,887,566

[45] Date of Patent: Dec. 19, 1989

[54] HYDRAULIC VALVE LASH ADJUSTER

[75] Inventor: Toshimitsu Shida, Fujisawa, Japan

[73] Assignee: Fuji Valve Co., Ltd., Tokyo, Japan

[21] Appl. No.: 332,360

[22] Filed: Apr. 3, 1989

[30] Foreign Application Priority Data

Sep. 30, 1988 [JP] Japan ..... 63-128400[U]

[51] Int. Cl.[4] ..... F01L 1/24

[52] U.S. Cl. ..... 123/90.51; 123/90.35; 123/90.55

[58] Field of Search ..... 123/90.51, 90.55, 90.56, 123/90.57, 90.35

[56] References Cited

U.S. PATENT DOCUMENTS

| | | | |
|---|---|---|---|
| 2,688,319 | 9/1954 | Humphreys | 123/90.55 |
| 2,938,508 | 5/1960 | Papenguth | 123/90.59 |
| 3,838,669 | 10/1974 | Dadd | 123/90.35 |
| 4,004,558 | 1/1977 | Scheibe | 123/90.35 |
| 4,437,439 | 3/1984 | Speil | 123/90.55 |
| 4,584,976 | 4/1986 | Hillebrand | 123/90.55 |
| 4,607,599 | 8/1986 | Buente et al. | 123/90.5 |
| 4,747,376 | 5/1988 | Speil et al. | 123/90.55 |
| 4,771,741 | 9/1988 | Leer | 123/90.5 |

FOREIGN PATENT DOCUMENTS

| | | | |
|---|---|---|---|
| 2343269 | 3/1975 | Fed. Rep. of Germany . | |
| 0170509 | 7/1988 | Japan | 123/90.55 |

*Primary Examiner*—Willis R. Wolfe
*Assistant Examiner*—Weilun Lo
*Attorney, Agent, or Firm*—Cushman, Darby & Cushman

[57] ABSTRACT

The present invention relates to a hydraulic valve lash adjuster which is capable of storing a large quantity of oil therein and exhibits high resistance to wear. In the valve lash adjuster in accordance with the invention, the plunger comprises an upper plunger portion and a lower plunger portion, at least a portion of a partition member extends over the joint between the upper and lower plunger portions, and the upper plunger portion being welded to the lower plunger portion by projection welding so that the partition member is deformed inward by bulging of the welded portion to fix the partition member within the plunger. Accordingly, the upper and lower plunger portions are welded together by projection welding, and simultaneously the partition member is sealingly fixed within the plunger. The plunger thus formed is surface hardened by quenching or carburizing. With the above construction of the invention, therefore, the hardness of the outer surface of the plunger is not impaired and the residual stresses generated by welding do not degrade the resistance to wear and fatigue.

4 Claims, 5 Drawing Sheets

HYDRAULIC VALVE LASH ADJUSTER

BACKGROUND OF THE INVENTION

1. Field of the Invention

The present invention relates to a hydraulic valve lash adjuster, and more specifically, to a hydraulic valve lash adjuster which is capable of storing a large quantity of oil therein and exhibits high resistance to wear.

2. Description of Related Art

The plunger of a hydraulic valve lash adjuster is provided with an internal reservoir for oil storage because oil cannot be instantly supplied from the exterior to the valve lash adjuster when the engine is started. Thus the oil stored in the reservoir provides a source of oil for use at the re-starting of the engine.

However, in a case where the valve lash adjuster is limited in length due to the design of the engine, or the valve lash adjuster has to be installed with a certain degree of inclination, the reservoir of the valve lash adjuster is unable to store an amount of oil sufficient for the re-starting of the engine. In order to eliminate such a disadvantage, it has been proposed to provide a generally cylindrical partition member within the plunger comprising an upper plunger portion and a lower plunger portion so as to increase the reservoir capacity.

Generally, the plunger of a valve lash adjuster performs rapid reciprocating movements relative to the body of the adjuster under the action of a cam during the operation of the engine. Since an inexpensive material such as carbon steel is used for manufacture of a plunger, the outer surface of the plunger has to be hardened by quenching or carburizing to avoid wear of the outer surface of the plunger due to its contact with the inner surface of the body.

Referring to FIG. 1, there is shown a conventional hydraulic valve lash adjuster comprising a cylindrical body 11 and a hollow plunger 12. The plunger 12 includes two portions, an upper plunger portion **12*a* and a lower plunger portion 12*b*. The upper plunger portion 12*a* is provided therein with a generally cylindrical partition member 21. The partition member 21 is inserted into the upper plunger portion 12*a* so as to define a space between itself and the plunger wall, and is secured at its lower end in fluid tight sealing engagement with the inner surface of the upper plunger portion 12*a* by means of press fitting. The upper plunger portion 12*a* is welded at its lower end to the upper end of the lower plunger portion 12*b***.

In manufacture of the plunger, the upper and lower plunger portions **12*a*, 12*b* are treated in advance by quenching or carburizing. The surface hardened portions 33 of the upper and lower plunger portions 12*a*, 12*b* at the regions to be welded are removed to facilitate welding. Then the partition member 21 is mounted in the upper plunger portion 12*a* before the upper and lower plunger portions 12*a*, 12*b* are welded together by, for example, projection welding. After the welding of the two portions, the plunger thus formed is incorporated into the body 11**.

Due to the fact that the two members constituting the plunger are welded together after the surface hardening, the surface hardness of the portions 33 of the upper and lower plunger portions adjacent to the welded portion 31 is seriously impaired and the residual stresses generated in the portions 33 by welding can degrade resistance to wear and fatigue.

Furthermore, during the operation of the valve lash adjuster, spatter particles 32 projecting inward from the welded portion 31 may come off and fall into the reservoir 20. As a result, the operation of a check valve 14 in the form of a ball can be impaired and the plunger can no longer perform smooth reciprocating movements within the body 11.

SUMMARY OF THE INVENTION

Accordingly, it is an object of the invention to eliminate the above-mentioned disadvantages and provide a hydraulic valve lash adjuster in which the plunger is subject to surface hardening after the two plunger portions are welded together so that the hardness of the outer surface of the plunger will not be impaired and so that the residual stresses generated by welding will not degrade the resistance to wear and fatigue.

The above and other objects of the present invention can be achieved by a hydraulic valve lash adjuster which includes a cylindrical body, a hollow plunger slidably received within the body and having a reservoir formed therein, a generally cylindrical partition member placed within the plunger to increase the reservoir capacity, and check valve means for permitting oil to flow only from the reservoir into a high-pressure chamber defined between the the bottom wall of the body and the bottom wall of the plunger, characterized in that the plunger comprises an upper plunger portion and a lower plunger portion, at least a portion of the partition member extends over the joint between the upper and lower plunger portions, and the upper plunger portion being welded to the lower plunger portion by projection welding so that the partition member is deformed inward by bulging of the welded portion to fix the partition member within the plunger.

Accordingly, the upper and lower plunger portions are welded together by projection welding, and simultaneously the partition member is sealingly fixed within the plunger. The plunger thus formed is surface hardened by quenching or carburizing. With the above construction of the invention, therefore, the hardness of the outer surface of the plunger is not impaired and the residual stresses generated by welding do not degrade the resistance to wear and fatigue.

In addition, the partition member can be fixed within the plunger by welding together the upper and lower plunger portions only. Therefore, less electric power is required compared with a valve lash adjuster in which the partition member has to be welded to the upper and lower plunger portions.

In a preferred embodiment of the invention, one of the upper and lower plunger portions is formed with an inner stepped portion for preventing the partition member from moving upward or downward. In such a valve lash adjuster, it is easier to position the partition member within the plunger before projection welding. Moreover, the stepped portion of the plunger cooperates with the deformed portion of the partition member to fix the partition member more tightly within the plunger.

In further specific embodiments of the invention, the stepped portion may be formed in the lateral wall of the upper plunger portion and the shoulder of the partition member engages the stepped portion to prevent the partition member from displacing upward, the lower end of the partition member being deformed inward. Alternatively, the stepped portion may be formed in the lateral wall of the lower plunger portion and the lower end of the partition member engages the stepped portion to prevent the partition member from displacing downward, the middle portion of the partition member being deformed inward.

The above and other objects, features and advantages of the present invention will become apparent from the following detailed description of preferred embodiments of the present invention with reference to the accompanying drawings.

DESCRIPTION OF THE PREFERRED EMBODIMENTS

Figure 1:
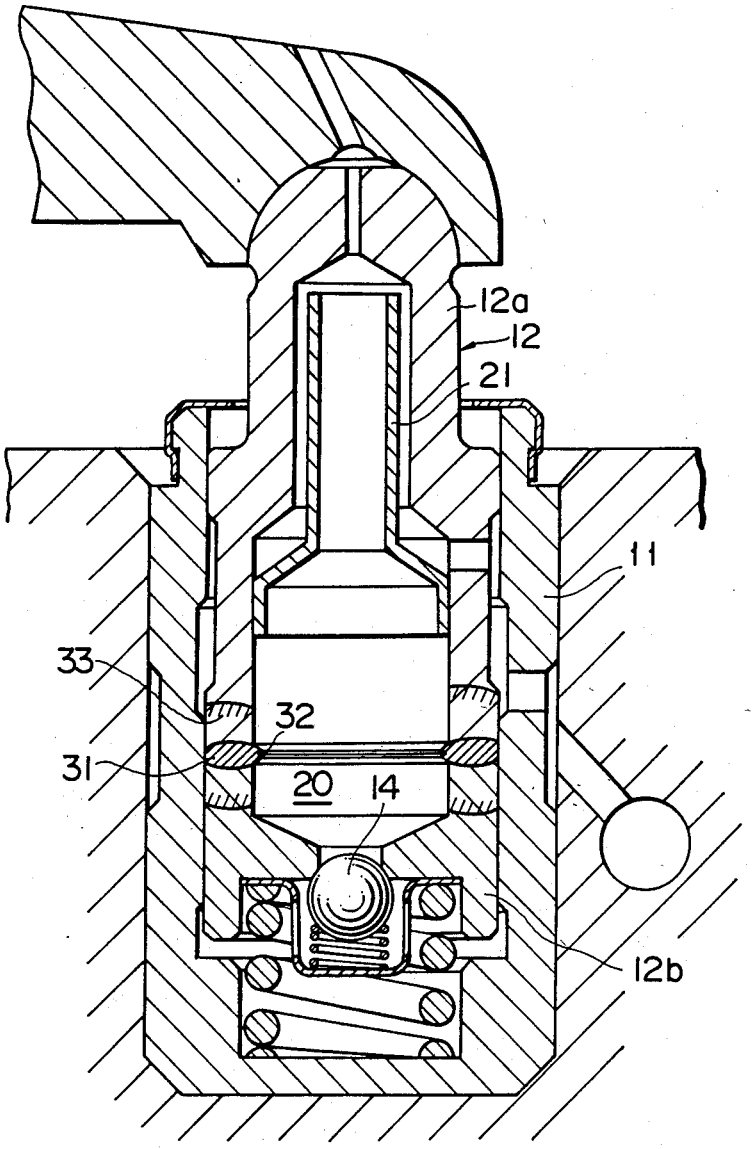
FIG. 1 is a cross sectional view showing the construction of a conventional hydraulic valve lash adjuster.
Figure 2:
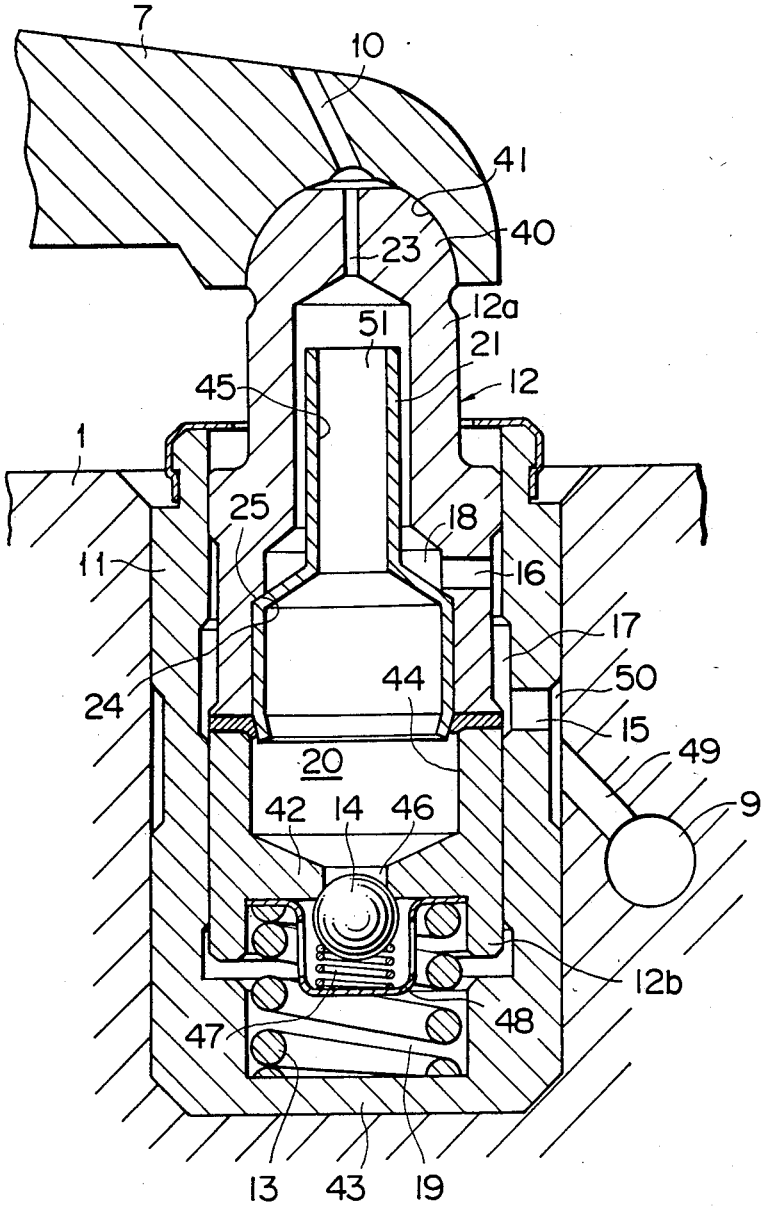
FIG. 2 is a cross sectional view showing the construction of a first embodiment of the hydraulic valve lash adjuster in accordance with the present invention.

Referring to FIG. 2, there is shown a hydraulic valve lash adjuster constructed in accordance with the present invention. Components similar to those of the valve lash adjuster shown in FIG. 1 are given the same reference numerals as in FIG. 1.

The shown hydraulic valve lash adjuster comprisies a cylindrical body 11 which is fitted within a cylinder head 1 and a hollow plunger 12 which is slidably received within the body 11. The plunger 12 includes two portions, an upper plunger portion 12*a* and a lower plunger portion 12*b*.

The upper plunger 12*a* is provided therein with a generally cylindrical partition member 21 which is inserted in the upper plunger portion 12*a* so as to define a space with the inner surface of the wall of the upper plunger portion 12*a* and secured at the lower portion in fluid tight sealing engagement with the inner surface of the wall of the upper plunger portion 12*a* by press fitting. A shoulder 25 of the partition member 21 abuts on a stepped portion 24 formed in the wall of the upper plunger 12*a* to position the partition member 21 within the upper plunger portion 12*a*.

The upper plunger portion 12*a* is welded at its lower end to the upper end of the lower plunger portion 12*b* by projection welding. The lower end of the partition member 21 is deformed inward by bulging of the welded portion during the projection welding, and thus the deformed end of the partition member 21 is in a tight contact with the welded portion.

The upper plunger portion 12*a* is formed at its upper end with a semi-spherically shaped upper end 40 which is slidably received within and in contact with a spherically concaved recess 41 in a rocker arm 7. A high-pressure chamber 19 is defined between the bottom wall 42 of the lower plunger portion 12*b* and the bottom wall 43 of the body 11. A reservoir 20 is defined by the inner surface 44 of the wall of the lower plunger portion 12*b* and the inner surface 45 of the wall of the partition member 21.

In the high pressure chamber 19, a return spring 13 is incorporated vertically between the bottom wall 42 of the lower plunger portion 12*b* and the bottom wall 43 of the body 11 to bias upwardly the plunger. The lower plunger portion 12*b* has an outlet port 46 centrally formed in the bottom wall 42 thereof. A check valve in the form of a ball 14 is held in place against the bottom wall 42 of the lower plunger portion 12*b* by another return spring 47 to close the outlet port 46. The return spring 47 is held in place by a retaining member 48 which is in turn held by the previously described return spring 13.

The cylinder head 1 is formed with an oil gallery 9, which communicates through a channel 49 with an annular channel 50 defined between the cylinder head 1 and the body 11. The annular channel 50 in turn communicates through a first inlet 15 with another annular channel 17 defined between the body 11 and the upper plunger portion 12*a*

The annular channel 17 communicates through a second inlet 16 further with an oil-introducing chamber 18 which is defined between the inner surface of the wall of the upper plunger portion 12*a* and the outer surface of the wall of the partition member 21. The chamber 18 communicates through the upper opening 51 of the partition member 21 with the reservoir 20. The upper plunger portion 12*a* is formed at its semi-spherically shaped end 40 with an oil discharge orifice 23, which in turn communicates with a passage 10 formed in the rocker arm 7.

Figure 3A:
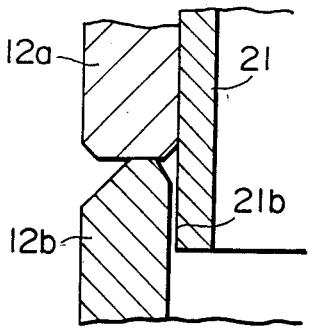
FIGS. 3A and 3B are enlarged cross sectional views respectively showing the construction of the joint between the upper and lower plunger portions before welding and after welding.

The upper plunger portion 12*a* and lower plunger portion 12*b* constituting the plunger 12 are separately formed. The partition member 21 is inserted into the upper plunger 12*a* until the shoulder 25 of the partition member 21 is brought into contact with the stepped portion 24 formed in the upper plunger portion 12*a*. The lower portion of the partition member 21 is secured in fluid tight sealing engagement with the inner surface of the wall of the plunger by press fitting. The partition member 21 is sized such that the lower end 21*b* extends beyond the joint between the upper and lower plunger portions as best shown in FIG. 3A.

Figure 3B:
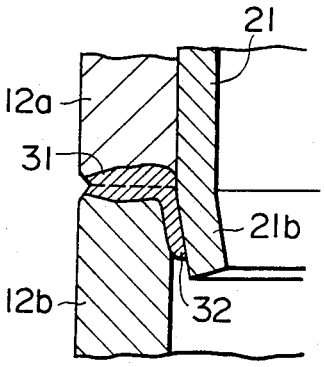

Thus, the lower end of the upper plunger portion 12*a* and the upper end of the lower plunger portion 12*b* are welded together by projection welding. As shown in FIG. 3B, a welded portion or melted portion 31 is bulged inward under the action of the force applied to the upper and lower plunger portions during the operation of the projection welding to deform inwardly the lower end 21*b* of the partition member 21, thereby forming an intimate joint between the welded portion 31 and the partition member 21.

The partition member is fixed within the upper plunger portion by the engagement of the shoulder 25 with the stepped portion 24 and by the contact of the inward bulging of the welded portion 31 with the inwardly deformed end of the partition member 21. Spatter particles 32 generated by welding is confined within a space defined between the lower end 21*b* of the partition member 21 and the upper plunger portion 12*a*. After the upper and lower plunger portions are welded together for formation of the plunger, it is subjected to an appropriate surface hardening process such as quenching.

The chamber 18 communicates only through the upper opening 51 of the partition member 21 with the reservoir 20 because the partition member 21 is jointed to the plunger 12.

In operation, oil under pressure is supplied through the oil gallery 9 t the hydraulic valve lash adjuster where the oil flows through the first inlet 15, annular channel 17, and second inlet 16 into the chamber 18. The oil thus introduced into the chamber 18 then flows through the upper opening 51 of the partition member 21 into the reservoir 20.

A portion of the oil is discharged through the oil discharge orifice 23 and the passage 10 to the exterior so as to effect lubrication of a cam which is not shown in the figures. The oil discharge orifice 23 also serves to discharge air introduced within the valve lash adjuster.

When the engine is stopped, the oil in the gallery 9 will drop into an oil pan (not shown). Furthermore, the oil in the first inlet 15, annular channel 17, second inlet 16 and chamber 18 gradually leaks out into the gallery 9, and as a result, oil remains only within the reservoir 20. Thus, the oil is stored to the level of the upper end face of the partition member 21. The oil thus stored in the reservoir 20 is sufficient to meet the need for oil comsumption within the high-pressure chamber 19 at the restarting of the engine.

Accordingly, in a hydraulic valve lash adjuster in accordance with the present invention, the plunger is constituted by an upper plunger portion and lower plunger portion welded together by projection welding, and the partition member is sealingly fixed within the plunger by the welded portion between the upper and lower plunger portions. Thus, the plunger can be subjected to an appropriate surface hardening treatment without danger of the partition member being displaced from its proper location under the thermal influence.

Although, in the first embodiment shown in FIG. 2, the upward displacement of the partition member is prevented by the stepped portion formed in the upper plunger portion, the partition member may be located within the upper plunger portion by bringing the upper end of the partition member into contact with the upper wall of the upper plunger portion. In this case, passages are formed in the upper end of the partition member for communication with chamber 18.

Figure 4:
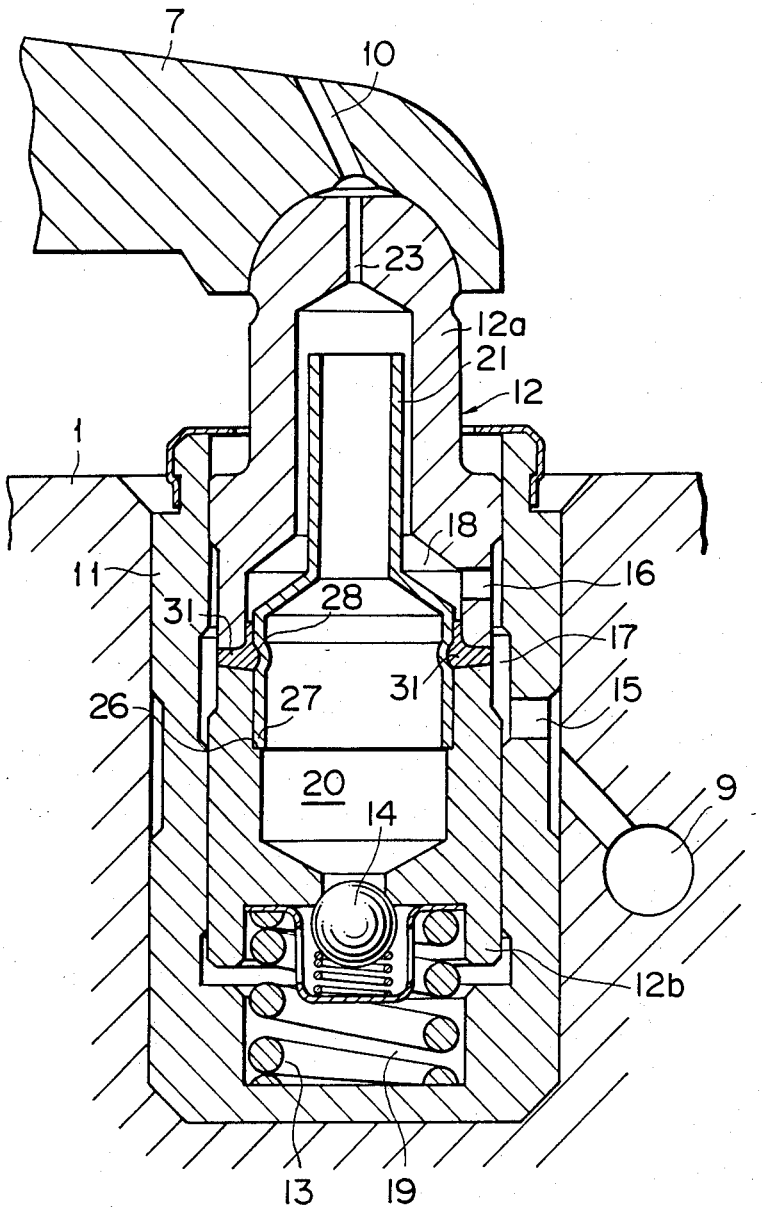
FIG. 4 is a cross sectional view showing the construction of a second embodiment of the hydraulic valve lash adjuster in accordance with the present invention.
Figure 5:
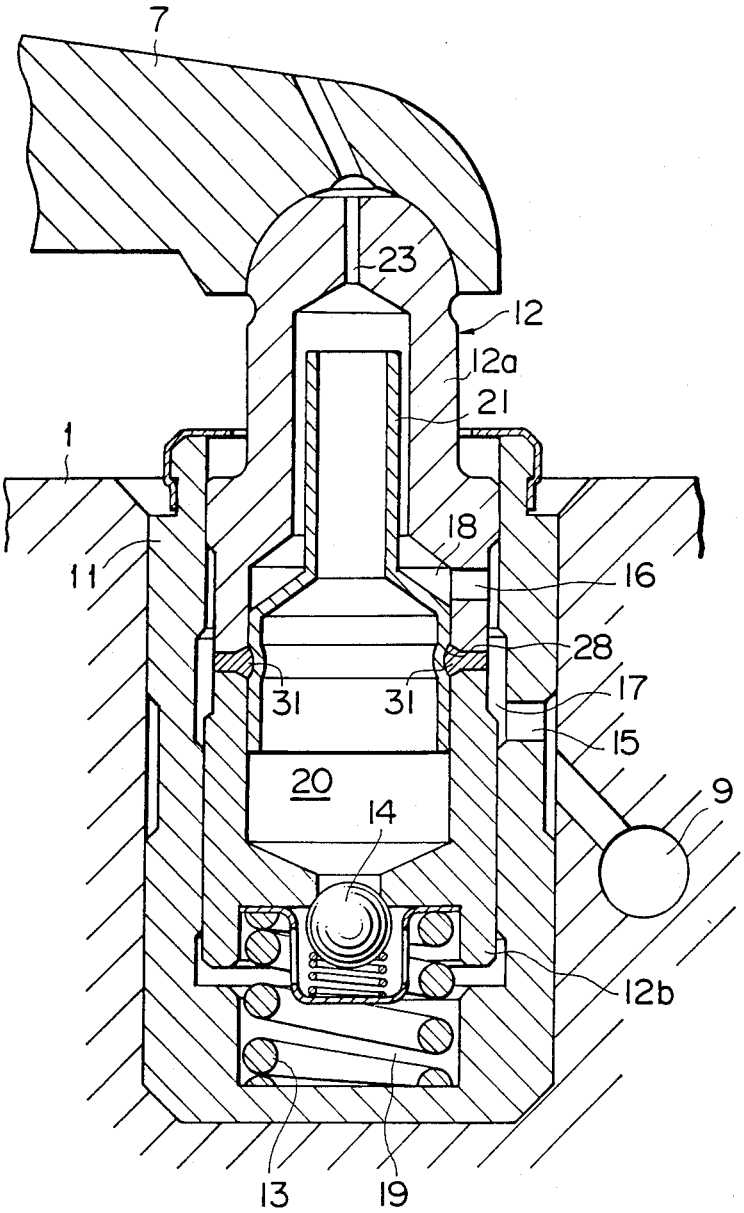
FIG. 5 is a cross sectional view showing the construction of a third embodiment of the hydraulic valve lash adjuster in accordance with the present invention.

Referring to FIGS. 4 and 5, there are respectively shown second and third embodiments of the hydraulic valve lash adjuster in accordance with the present invention. Components similar to those of the valve lash adjuster shown in FIG. 2 are given the same reference numerals as in FIG. 2.

In the second embodiment shown in FIG. 4, the lower portion of the partition member 21 is press fitted into the lower plunger portion **12*b* until the end face of the lower end 27 of the partition member 21 abuts on a stepped portion 26 which is formed in the wall of the lower plunger portion 12*b*. Thus, the lower end of the upper plunger portion 12*a* and the upper end of the lower plunger portion 12*b*** are welded together by projection welding.

During the operation of the projection welding, melting metal is extruded inward to deform inward the middle portion of the partition member 21 facing the welded portion 31 into the form of an annular concave recess 28. Consequently, the partition member 21 is sealingly fixed within the plunger 12, and, more specifically, its lower plunger portion **12*b***.

In the third embodiment shown in FIG. 5, unlike the first and second embodiments, any stepped portion is formed in neither the upper plunger portion nor the lower plunger portion. In this embodiment, the partition member 21 is located by an appropriate means with respect to the joint between the upper and lower plunger portions, and then the upper and lower plunger portions are welded together by projection welding. During the operation of the projection welding, an annular concave recess 28 is formed in the partition member 21 by the bulging of the welded portion as in the second embodiment to sealingly fix the partition member 21 within the plunger.

The second and third embodiments operate in the same manner as the first embodiment.

Although the invention thus has been shown and described with reference to specific embodiments, it should be noted that the present invention is in no way limited to the details of the illustrated structures but changes and modifications may be made within the scope of the appended claims.

I claim:

1. A hydraulic valve lash adjuster which includes a cylindrical body; a hollow plunger slidably received within the body and having a reservoir formed therein; a generally cylindrical partition member placed within the plunger to increase the reservoir capacity; and check valve means for permitting oil to flow only from the reservoir into a high-pressure chamber defined between the bottom wall of the body and the bottom wall of the plunger; characterized in that the plunger comprises an upper plunger portion and a lower plunger portion, at least a portion of the partition member extends over the joint between the upper and lower plunger portions, and the upper plunger portion being welded to the lower plunger portion by projection welding so that the partition member is deformed inward by bulging of the welded portion to fix the partition member within the plunger.

2. A hydraulic valve lash adjuster as set forth in claim 1, wherein one of the upper and lower plunger portions is formed with an inner stepped portion for preventing the partition member from displacing upward or downward.

3. A hydraulic valve lash adjuster as set forth in claim 2, wherein the stepped portion is formed in the wall of the upper plunger portion to prevent the partition member from displacing upward, the lower end of the partition member being deformed inward by bulging of the welded portion.

4. A hydraulic valve lash adjuster as set forth in claim 2, wherein the stepped portion is formed in the wall of the lower plunger portion to prevent the partition member from displacing downward, the middle portion of the partition member being deformed inward by bulging of the welded portion.

* * * * *